US011408105B2

(12) United States Patent
Dealey et al.

(10) Patent No.: US 11,408,105 B2
(45) Date of Patent: Aug. 9, 2022

(54) KNITTING FEEDER WITH A CUTTING DEVICE

(71) Applicant: NIKE, Inc., Beaverton, OR (US)

(72) Inventors: Stuart W. Dealey, Portland, OR (US); Adrian Meir, Portland, OR (US); Gagandeep Singh, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/941,037

(22) Filed: Mar. 30, 2018

(65) Prior Publication Data

US 2018/0282914 A1 Oct. 4, 2018

Related U.S. Application Data

(60) Provisional application No. 62/479,718, filed on Mar. 31, 2017.

(51) Int. Cl.

| | |
|---|---|
| ***D04B 15/56*** | (2006.01) |
| ***D04B 15/48*** | (2006.01) |
| ***D04B 7/14*** | (2006.01) |
| ***D04B 15/70*** | (2006.01) |

(52) U.S. Cl.

CPC ..... *D04B 15/565* (2013.01); *D04B 7/14* (2013.01); *D04B 15/48* (2013.01); *D04B 15/70* (2013.01)

(58) Field of Classification Search

CPC ..... D04B 15/565; D04B 7/14; D04B 15/70; D04B 15/48; D04B 15/38; D04B 27/10; D04B 15/60

USPC ..... 66/125 R, 134, 140 R, 142, 145 R

See application file for complete search history.

(56) References Cited

U.S. PATENT DOCUMENTS

| | | | | |
|---|---|---|---|---|
| 2,357,708 A * | 9/1944 | Toone | D04B 9/18 | 66/134 |
| 2,384,214 A * | 9/1945 | Toone | D04B 9/46 | 66/134 |
| 2,838,923 A * | 6/1958 | Lassiter | B65H 59/38 | 66/132 R |

(Continued)

FOREIGN PATENT DOCUMENTS

| | | |
|---|---|---|
| CN | 1584167 A | 2/2005 |
| CN | 104278424 A | 1/2015 |

(Continued)

OTHER PUBLICATIONS

Preliminary Report on Patentability dated Oct. 1, 2019 for PCT Application No. PCT/US2018/025355, 11 pages.

(Continued)

*Primary Examiner* — Danny Worrell
*Assistant Examiner* — Aiying Zhao
(74) *Attorney, Agent, or Firm* — Shook Hardy & Bacon, L.L.P.

(57) ABSTRACT

A feeder for a knitting machine may include: a carrier configured to secure the feeder to a knitting machine such that the feeder is movable along an axis with respect to a rail of the knitting machine; a feeder arm extending from the carrier, the feeder arm including a dispensing area configured for supplying a yarn to a needle bed of the knitting machine; and a cutting device coupled to the feeder arm, where the cutting device includes a cutting edge for cutting the yarn to disengage an upper portion of the yarn from the needle bed of the knitting machine.

16 Claims, 6 Drawing Sheets

(56) References Cited

U.S. PATENT DOCUMENTS

| | | | | |
|---|---|---|---|---|
| 2,869,343 | A * | 1/1959 | Toone | D04B 9/18 66/134 |
| 2,934,922 | A * | 5/1960 | Reading, Jr. | D04B 11/00 66/145 R |
| 3,252,307 | A * | 5/1966 | Kaese | D04B 15/60 66/49 |
| 3,890,809 | A * | 6/1975 | Tenconi | D04B 15/60 66/132 R |
| 4,137,732 | A * | 2/1979 | Gostelow | D04B 15/60 66/125 R |
| 4,658,603 | A | 4/1987 | Stoll et al. | |
| 5,615,562 | A * | 4/1997 | Roell | D04B 1/123 66/126 R |
| 6,073,466 | A * | 6/2000 | Marchesi | D04B 1/24 139/434 |
| 9,060,570 | B2 * | 6/2015 | Huffa | D04B 1/123 |

FOREIGN PATENT DOCUMENTS

| | | | |
|---|---|---|---|
| CN | 104420069 | A | 3/2015 |
| DE | 35 31 341 | A1 | 4/1986 |
| EP | 0 331 650 | A2 | 9/1989 |
| EP | 1666653 | A1 | 6/2006 |
| EP | 1 788 131 | A1 | 5/2007 |
| EP | 1 788 132 | A1 | 5/2007 |
| GB | 1 269 109 | A | 4/1972 |
| GB | 2 064599 | A | 6/1981 |
| GB | 2193229 | A | 2/1988 |
| JP | S 49111 | B1 | 1/1974 |
| JP | H 11335970 | A | 12/1999 |
| WO | WO 88/08892 | A1 | 11/1988 |
| WO | WO 97/45579 | A1 | 12/1997 |

OTHER PUBLICATIONS

International Search Report and Written Opinion dated May 9, 2018 for PCT Application No. PCT/US2018/025355, 15 pages.

Office Action dated Jun. 1, 2020 for Chinese Application No. 201880023251.8, 18 pages.

Extended European Search Report in Corresponding European Application No. 20188250.3 dated Nov. 6, 2020 (8 pages).

Intention to Grant received for European Patent Application No. 20188250.3, dated Sep. 15, 2021, 8 pages.

* cited by examiner

KNITTING FEEDER WITH A CUTTING DEVICE

RELATED APPLICATIONS

This application claims the benefit of U.S. Provisional Application No. 62/479,718, filed Mar. 31, 2017, which is hereby incorporated by reference in its entirety.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Knitting is an example of a process that may form a textile. Knitting may generally be classified as either weft knitting or warp knitting. In both weft knitting and warp knitting, one or more yarns are manipulated to form a plurality of intermeshed loops that define a variety of courses and wales. In weft knitting, which is more common, the courses and wales are perpendicular to each other and may be formed from a single yarn or many yarns. In warp knitting, the wales and courses run roughly parallel.

Although knitting may be performed by hand, the commercial manufacture of knitted components is generally performed by knitting machines. An example of a knitting machine for producing a weft knitted component is a V-bed flat knitting machine, which includes two needle beds that are angled with respect to each other. Rails extend above and parallel to the needle beds and provide attachment points for feeders, which move along the needle beds and supply yarns to needles within the needle beds. Standard feeders have the ability to supply a yarn that is utilized to knit, tuck, and float. In situations where an inlay yarn is incorporated into a knitted component, an inlay feeder is typically utilized.

BRIEF SUMMARY

One general aspect of the present disclosure includes a feeder for a knitting machine, the feeder including: a carrier configured to secure the feeder to a knitting machine such that the feeder is movable along an axis with respect to a rail of the knitting machine; a feeder arm extending from the carrier, the feeder arm including a dispensing area configured for supplying a yarn to a needle bed of the knitting machine; and a cutting device coupled to the feeder arm, where the cutting device includes a cutting edge for cutting the yarn to disengage an upper portion of the yarn from the needle bed of the knitting machine.

In some embodiments, the feeder further includes a gripping device coupled to the feeder arm for gripping a distal end of the yarn when the yarn is cut by the cutting device. The gripping device may be configured to be disengaged with the yarn when the yarn is being dispensed to the needle bed by the dispensing area of the feeder arm. The feeder may further include a starting device configured to engage a distal end the yarn with the needle bed. The starting device may include an outlet for dispensing a pressurized gas to guide the distal end of the yarn to a needle of the needle bed during a starting procedure. The feeder arm may have a second dispensing area configured for supplying a second yarn to the needle bed of the knitting machine. A second cutting device may be coupled to the feeder arm, where the second cutting device includes a second cutting edge for cutting the second yarn to disengage an upper portion of the second yarn from the needle bed of the knitting machine. A second gripping device may be adjacent to the second cutting device for engaging the second yarn when the second yarn is cut.

Another general aspect includes a feeder for a knitting machine, the feeder including: a carrier configured to secure the feeder to a knitting machine such that the feeder is movable along an axis with respect to a rail of the knitting machine; and a feeder arm extending from the carrier, the feeder arm including a first dispensing area configured for supplying a first yarn to a needle bed of the knitting machine and a second dispensing area configured for supplying a second yarn to a needle bed of the knitting machine.

In some embodiments, the feeder includes a first cutting device coupled to the feeder arm, where the first cutting device is configured to cut the first yarn to disengage the first yarn from the needle bed of the knitting machine. A first gripping device may be coupled to the feeder arm for gripping a distal end of the first yarn when the first yarn is cut by the first cutting device. A second gripping device may be coupled to the feeder arm for gripping a distal end of the second yarn when the second yarn is cut by a second cutting device. The first gripping device may be configured to be disengaged with the first yarn when the first yarn is being dispensed to the needle bed at a dispensing area of the feeder arm. A starting device may be included and configured to engage a distal end of at least one of the first yarn and the second yarn with the needle bed, where the starting device includes an outlet for dispensing a pressurized gas to guide the distal end of at least one of the first yarn and the second yarn to a needle of the needle bed during a starting procedure.

Another general aspect includes a method, the method including: knitting with a first yarn with a feeder; cutting the first yarn with a first cutting device, the first cutting device being coupled to an arm of the feeder; gripping the first yarn with a first gripping device, the first gripping device being coupled to the arm of the feeder; and knitting with a second yarn with the feeder.

In some embodiments, the method further includes cutting the second yarn with a second cutting device coupled to the arm of the feeder; gripping the second yarn with a second gripping device coupled to the arm of the feeder; and again knitting with the first yarn with the feeder. The method may include the step of engaging the second yarn with a needle bed using a starting device prior to knitting with the second yarn. Engaging the second yarn with the needle bed may include releasing pressurized gas to guide the second yarn to the needle bed.

DETAILED DESCRIPTION

Figure 1:
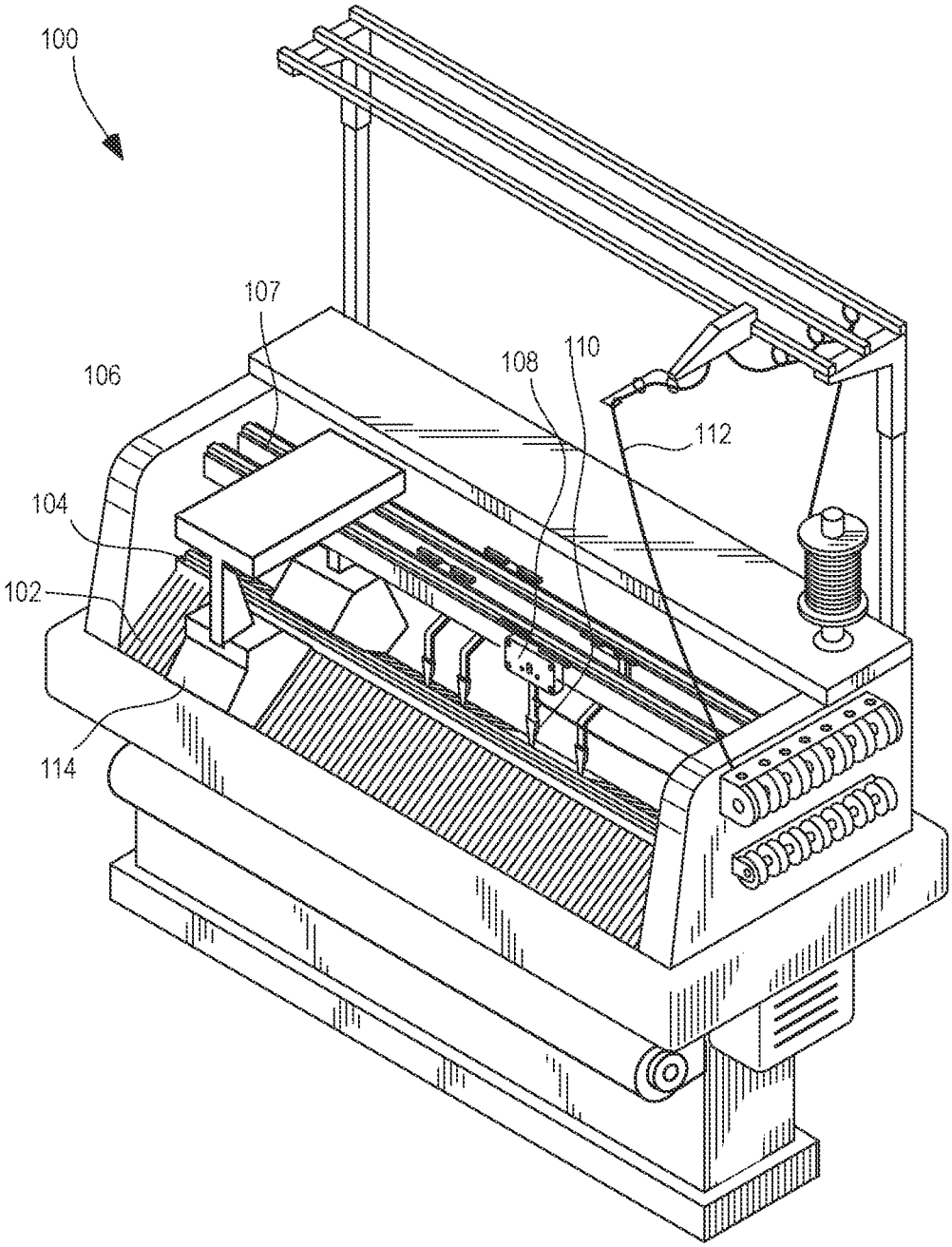
FIG. 1 shows a knitting machine in accordance with the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

FIG. 1 shows a knitting machine 100 with two needle beds (a front or first needle bed 102 and a back or second needle bed 104) that are angled with respect to each other (e.g., thereby forming a V-bed). The needles of the first needle bed 102 may lay on a first plane, and the needles of the second needle bed 104 may lay on a second plane. The first plane and the second plane may be angled relative to each other and meet to form an intersection (or axis) that extends along a majority of a width of the knitting machine 100. The needles each may have a first or neutral position where they are retracted and a second or extended position where they are extended. In the neutral position, an end of the needles is spaced from the intersection, and in the extended position, the needles pass through the intersection. The needles, needle beds, and intersection are described in additional detail in U.S. patent application Ser. No. 13/048,540, patented as U.S. Pat. No. 9,060,570, which is herein incorporated by reference in its entirety.

One or more rails 106 may extend above and parallel to the intersection and may provide attachment points for one or more feeders 108. Herein, the rails 106 are defined by a track for which a feeder 108 may couple to in a movable manner. The rails 106 may be secured to a body 107, where the body 107 includes a rail 106 on each side (e.g., on two sides as shown) (and where each of the rails 106 are configured to couple to a different feeder 108). Two rails 106 are included in the depicted embodiment, but more or fewer than two rails 106 may be included. The feeders 108 may include a dispensing area 110 located near the intersection and configured to dispense a yarn 112 to at least one of the first needle bed 102 and the second needle bed 104 as it moves along the intersection.

The knitting machine 100 may include a carriage 114 (also called a cam box) that is movable along the first needle bed 102 and the second needle bed 104. An upper portion 116 of the carriage 114 may include a set of plungers (described in more detail below) that can selectively engage at least one of the feeders 108 such that the feeder 108 that is engaged moves along one of the rails 108 as the carriage 114 moves. As the carriage 114 moves along the first needle bed 102 and the second needle bed 104, the carriage 114 may selectively actuate needles of the first needle bed 102 and/or the second needle bed 104 such that the actuated needles move from the default position to the extended position. The actuation may be the result of a set of cams (not shown in FIG. 1) of the carriage 114 making contact with a butt portion of the needles and forcing the needles to move from the default position to the extended position as the carriage 114 passes. Due to the action of the carriage 114, the feeder 108, and the needles, the yarn 112 may be dispensed from the feeder 108 and to the needles of at least one of the first needle bed 102 and the second needle bed 104.

Figure 2:
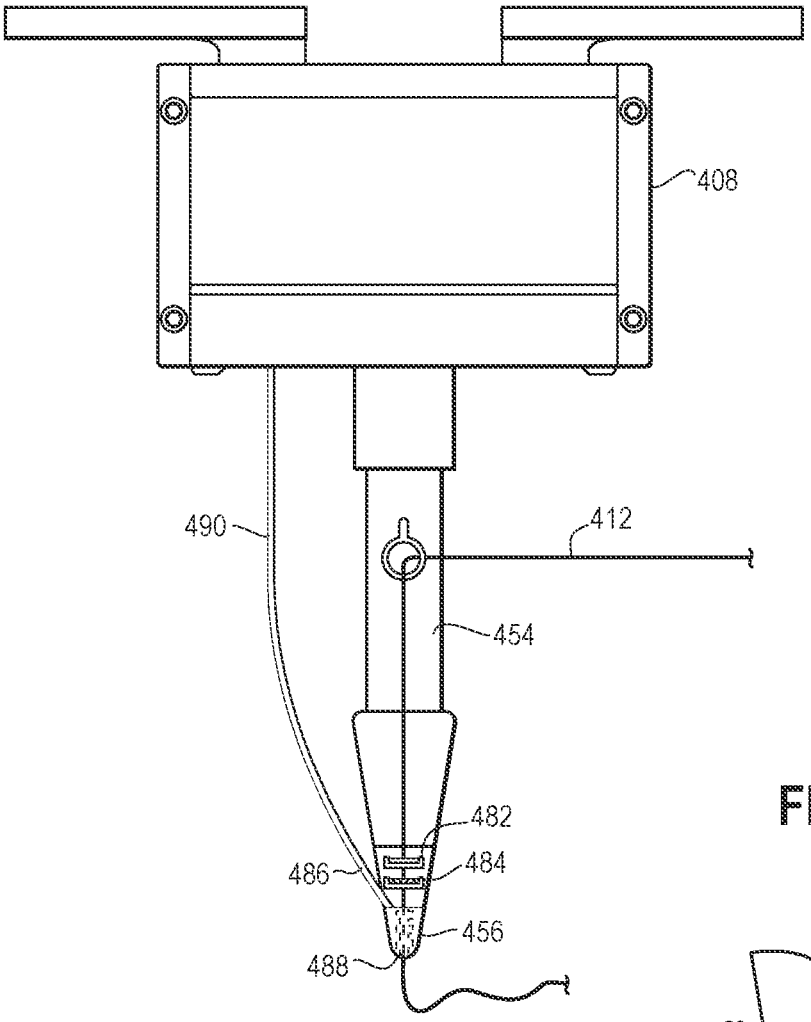
FIG. 2 shows a feeder with a cutting device, a gripping device, and a starting device in accordance with the present disclosure.

FIG. 2 shows a feeder 408 for a knitting machine 400 with a cutting device 482 and a gripping device 484. The cutting device 482 and/or the gripping device 484 may be actuated via a motor also coupled to the feeder 408, via mechanical means (e.g., if a plunger is configured to contact and move an actuation surface coupled to the cutting device 482 and/or the gripping device), or by another suitable device or method. The cutting device 482 may be coupled to the feeder arm 454, where the cutting device 482 is configured to selectively cut the yarn 412 when it is desired to disengage the yarn 412 from the needle bed of the knitting machine. For example, the yarn 412 may advantageously be cut and disengaged from a needle bed in the middle of a course when it would be desirable for the yarn 412 to be located at a first area of a knitting component but undesirable at a second area of the knitting component, where both the first area and the second area are at least partially formed by the course.

The feeder 408 may additionally or alternatively include the gripping device 484 coupled to the feeder arm 454. The gripping device 484 may be adjacent to the cutting device 482, as shown. When the feeder 408 is knitting with the yarn 412 or the yarn 412 is otherwise being dispensed from a dispensing area 456 of the feeder, the gripping device 484 may be disengaged with the yarn 412 (e.g., it may allow the yarn 412 to pass freely past the gripping device 484). When a cut occurs, the gripping device 484 may actuate simultaneously with the cutting device 482 to grip a cut end of the yarn 412 when the yarn 412 is cut by the cutting device. The gripping device 484 may be advantageous for ensuring the yarn 412 remains coupled to the feeder arm 454 after a cut such that it does not interfere with the knitting bed or other portions of the knitting machine and/or the knitting process. Additionally or alternatively, the gripping device 484 may keep the cut end of the yarn 412 near the dispensing area 456 of the feeder 408 such that it can be quickly and potentially automatically re-engaged with the needle bed when desired (as described in more detail below).

The feeder 408 may include a starting device 486 configured to engage the cut end of the first yarn 412 with the needle bed. While any suitable starting device is contemplated, in the depicted embodiment, the starting device 486 includes an outlet 488 for dispensing a pressurized gas to guide the cut end of the yarn 412 to a needle of the needle bed during a starting procedure. For example, the pressurize gas, which may be air, may be provided through a tube 490 and may be released by a valve just as the gripping device 484 released the cut end of the yarn 412. The force provided on the cut end of the yarn 412 by the pressurized gas flowing out of the outlet 488 may direct the cut end into a proper position such that a needle engages with the cut end as the feeder 408 moves along the needle bed.

Figure 2A:
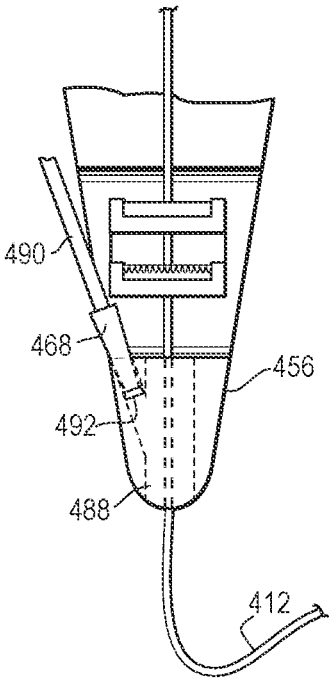
FIG. 2A shows the starting device of FIG. 7.

FIG. 2A shows a cutout view of an embodiment of the starting device 468. The yarn 412 may extend through the outlet 488, which may be located in the dispensing area 456 of the feeder. The pressurized gas may be provided to the outlet 488 through the tube 490. When released to the outlet 488 by a valve 492, the pressurized gas may quickly flow out of the bottom of the outlet 488, thereby directing the yarn towards out of the outlet 488 and towards a needle bed for engagement with a needle. Other embodiments are also contemplated (for example, in some embodiments, the yarn 412 does not share an outlet chamber with the tube 490 of pressurized gas).

Figure 3:
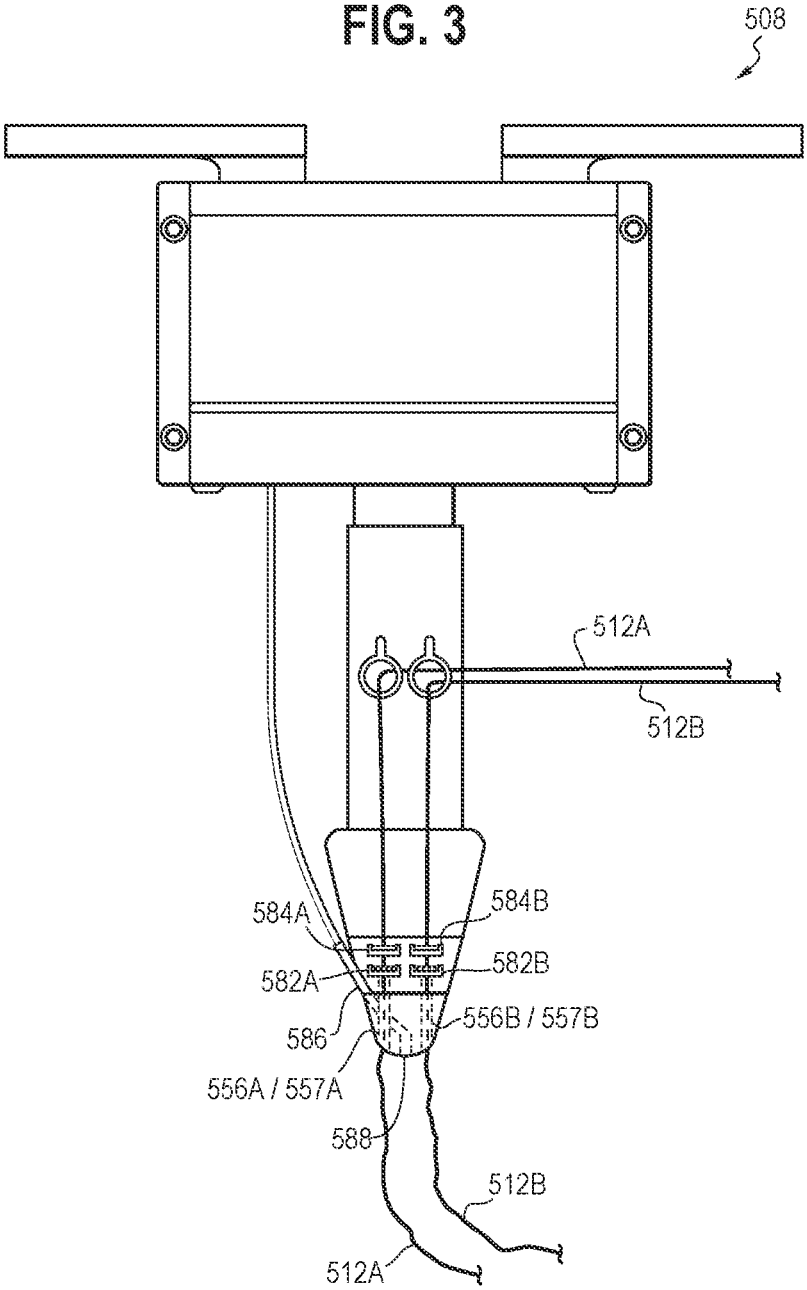
FIG. 3 shows a feeder with more than one dispensing area for more than one yarn in accordance with the present disclosure.

As shown in FIG. 3, a feeder 508 may have more than one dispensing area 556, where each dispensing area 556 is associated with a different yarn 512. As depicted, a first dispensing area 556A (with a first yarn opening 557A) for a first yarn 512A and a second dispensing area 556B (with a second yarn opening 557B) for a second yarn 512B may be included. In other embodiments, more than two dispensing areas for more than two respective yarns may be included.

The feeder 508 may include a first cutting device 582A and a second cutting device 582B, where the first cutting device 582A and the second cutting device 582B are configured to cut the first yarn 512A and the second yarn 5126, respectively. Similarly, a first gripping device 584A may be configured to grip the first yarn 512A and a second gripping device 584B may be configured to grip the second yarn 5126. The first cutting device 582A and the second cutting device 582B may be individually and selectively actuatable, and similarly the first gripping device 584A and the second gripping device 584B may be individually and selectively actuatable. In some embodiments the first gripping device 584A may actuate when the first cutting device 582A actuates and the second gripping device 584B may actuate when the second cutting device 582B actuates.

Figure 6:
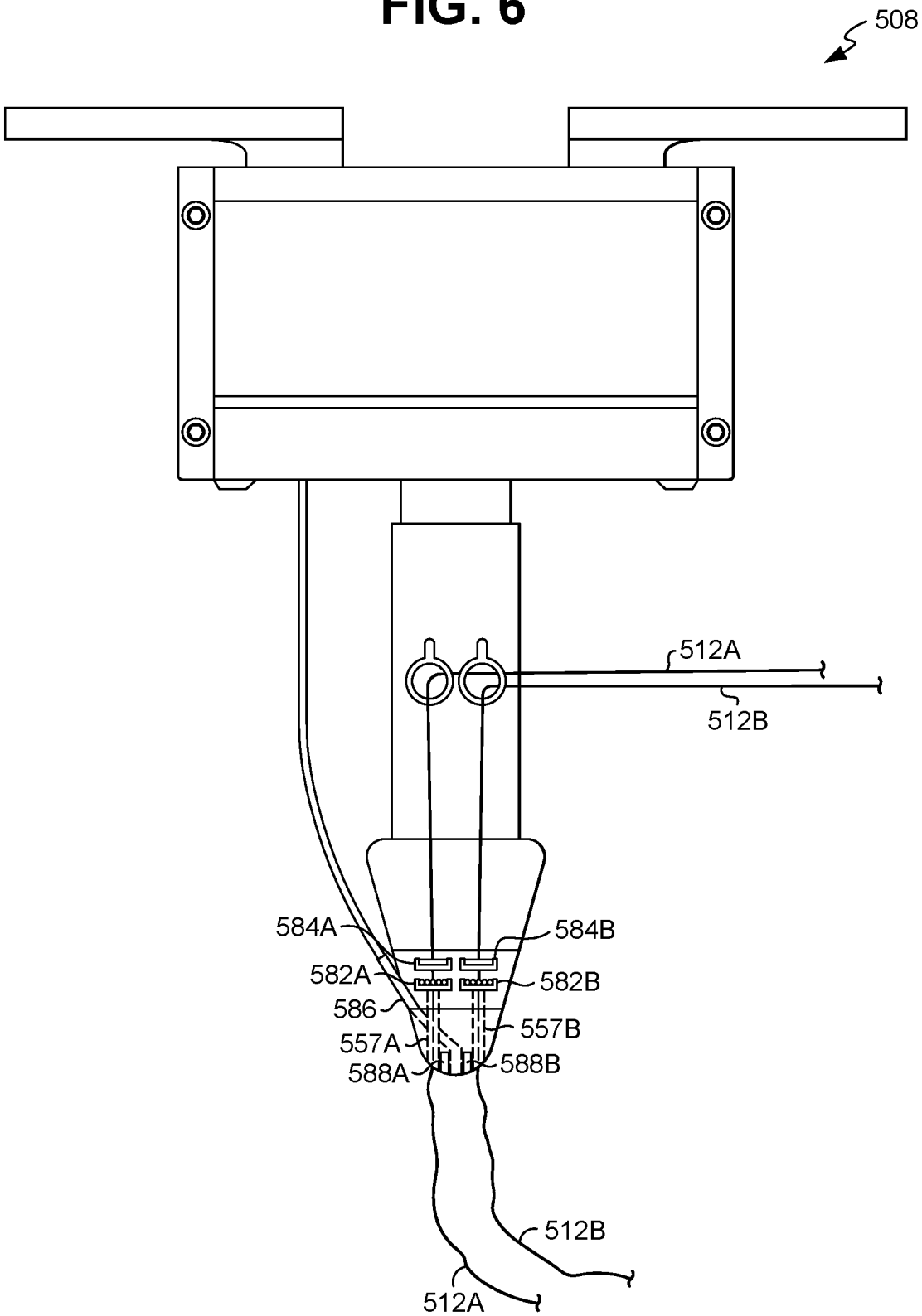
FIG. 6 shows a feeder having a first outlet and a second outlet in accordance with the present disclosure.

The feeder 508 may also include at least one starting device 586 configured to engage a cut end of at least one of the first yarn 512A and the second yarn 512B with the needle bed. As described above, the starting device 586 may include an outlet 588 for dispensing a pressurized gas to guide the cut end of the at least one of the yarns 512A, 512B to a needle of the needle bed during a starting procedure. While one outlet 588 may be sufficient to perform a starting procedure for both the first yarn 512A and the second yarn 512B, the feeder 508 may alternatively include an individual outlet associated with each of the yarns. This configuration is depicted in FIG. 6, which depicts the feeder 508 having two individual outlets 588A and 588B which perform the starting procedure for the first yarn 512A and the second yarn 512B, respectively.

Advantageously, the feeder 508 may provide the ability to switch from knitting with the first yarn 512A to knitting with the second yarn 5128 without manual intervention. This switch may occur before, after, or during the knitting of a course. Thus, it may provide the capability of switching between knitting with the first yarn 512A and the second yarn 5128 on adjacent or spaced apart courses of a knitting component and/or within a single course of the knitting component. Further, a knitting machine with a feeder 508 capable of switching yarn types may be advantageous where more yarn types that feeders are desired.

While not shown, the feeder 508 is not limited to two yarns, and may include three or more yarns, where the feeder 508 has the devices and features described above with respect to each of (or at last a portion of) the three or more yarns. It is further contemplated that more than one dispensing area may dispense their respective yarns to a needle bed simultaneously, which may be advantageous where knitting with more than one yarn is desirable.

Figure 4:
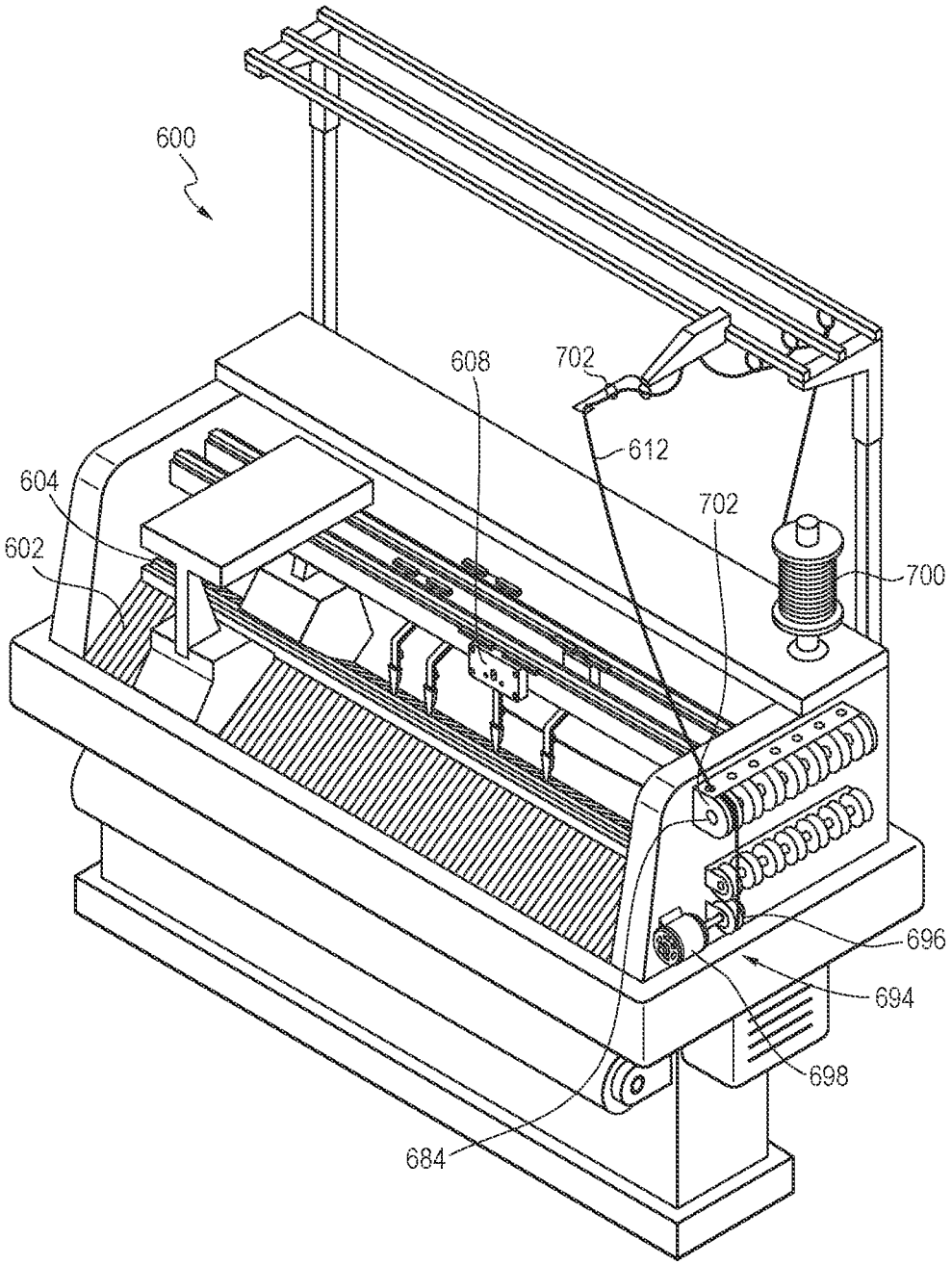
FIG. 4 shows a knitting machine with a tension control system in accordance with the present disclosure
Figure 5:
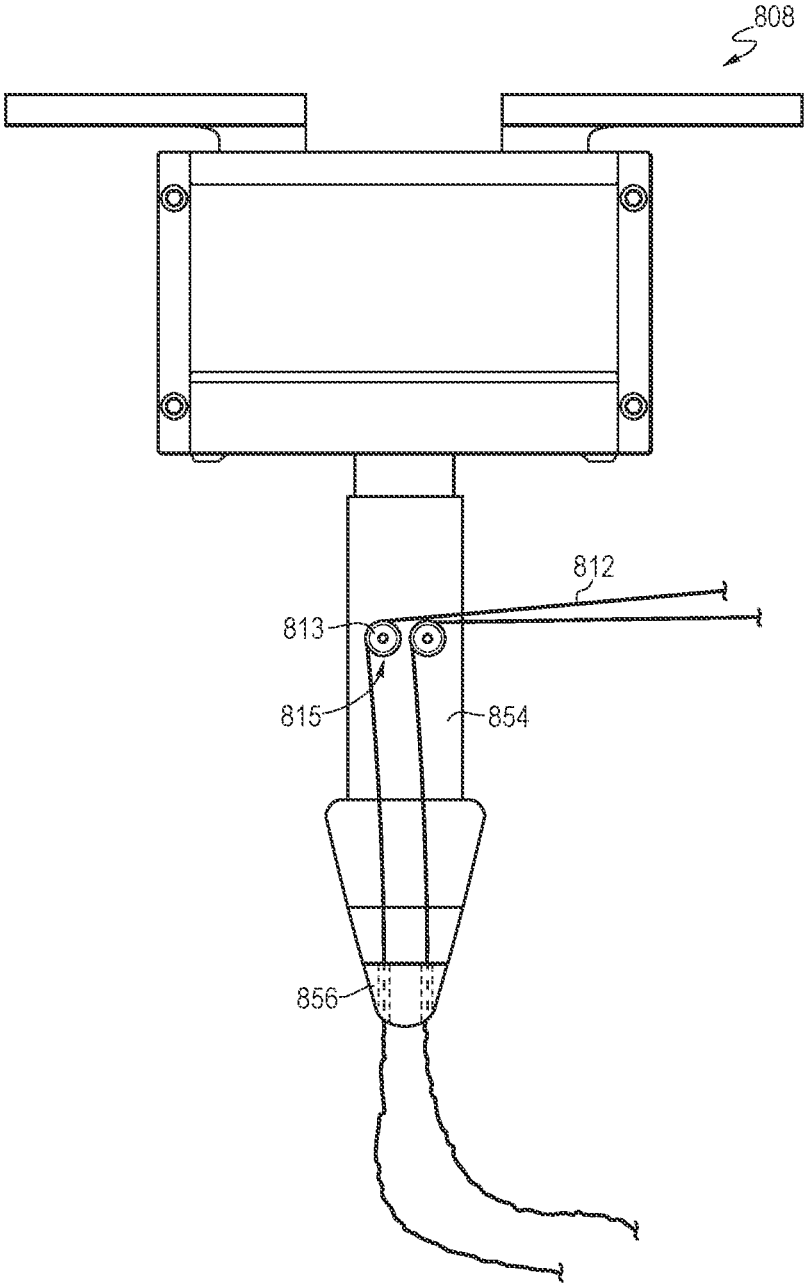
FIG. 5 shows a feeder with friction-reducing features in accordance with the present disclosure.

Referring to FIG. 5, when the gripping device 684 of FIG. 4 described above is activated, it may be desirable to provide the yarn 612 with a particular tension such that the yarn 612 does not develop slack that interferes with one of the needle beds 602, 604 and/or the knitting process. It also may be desirable to ensure that an appropriate tension is applied to the yarn 612 when, and if, the yarn 612 is re-engaged with at least one of the needle beds 602, 604 (as described above). Thus, it may be advantageous to include a tension system 694 for the knitting machine 600 depicted in FIG. 4.

The tension system 694 may include a tension controller 696 coupled to a frame of the knitting machine 600, as shown. The tension controller 696 may dispense the yarn 612 at a height suitable for a path of extension of the yarn 612 from the tension controller 696 to the feeder 608, for example. In some embodiments, the yarn 612 may extend from the tension controller 696 to the feeder 608 in a path that is substantially parallel to the intersection of the needle beds 602, 604, but this is not required in all embodiments.

The tension controller 696 may be any suitable mechanically-controlled or digitally-controlled tension controller capable of managing and controlling the tension within the yarn 612. For example and as depicted, the tension controller 696 may have two driven rolls driven by a motor 698 in some embodiments. A spring-driven spool or bobbin 700 may manage slack upstream of the tension controller 696. In some embodiments, the tension controller 696 may be capable of adjusting tension upon receipt of digital instructions such that the tension controller 696 is controllable via a digital electronic control system, which may be manually operated by a user and/or programmable.

The tension controller 696 may be the last point of contact between the knitting machine 600 and the yarn 612 prior to the yarn 612 being received by the feeder 608. Advantageously, the tension controller 696 may therefore achieve precise control of the tension in the yarn 612 since no friction on the yarn 612 will occur between the tension controller 696 and the feeder 608. All upstream friction (e.g., friction due to guide devices 702 located upstream of the tension controller 696) may be absorbed by the tension controller 696 prior to reaching the feeder 608, and thus having respectively little or substantially no impact on the tension of the yarn 612 upon receipt by the feeder 608.

Referring to FIG. 5, to enhance management of tension in the yarn 812, a pulley 813 may be secured to a feeder arm 854 of a feeder 808. The pulley 813 may include a yarn-receiving surface 815 configured to guide the yarn 812 as it extends to the dispensing area 856 of the feeder 808. The pulley 813 may have a relatively reduced effect on the tension of the yarn 812 at the dispensing area 856 due to relatively reduced friction with respect to other structures (e.g., an eyelet). Alternatively, other suitable guide devices may be included (like eyelets), and the friction associated with such devices may be ignored if determined to be insubstantial, or may be dealt with by the tension controller at a location upstream of the feeder 808. It is further contemplated that at least one tension controller may be coupled to the feeder itself.

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Turning now to FIG. 6, a feeder arm 508 may include a first outlet 588A located at a distal end of the feeder arm 508, and a second outlet 588B located at the distal end of the feeder arm 508. Generally, the first outlet 588A may be configured to direct a pressurized gas to guide a distal end of the first yarn 512A, and the second outlet 588B may be configured to direct a pressurized gas to guide a distal end of the second yarn 512B. The feeder arm 508 may further comprise a first yarn opening 557A configured for directing the distal end of only the first yarn 512A, and a second yarn opening 557B configured for directing the distal end of only the second yarn 512B, such that the first yarn opening 557A may be located below the first cutting device 582A and the second yarn opening 557B may be located below the second cutting device 582B. Finally, please note that the depiction of FIG. 6 is for general illustration only.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

We claim:

1. A feeder for a knitting machine, the feeder comprising:

a carrier configured to secure the feeder to a knitting machine such that the feeder is movable along an axis with respect to a rail of the knitting machine;

a feeder arm extending from the carrier, the feeder arm including a dispensing area configured for supplying a first yarn to a needle bed of the knitting machine;

a first cutting device coupled to the feeder arm, wherein the first cutting device includes a cutting edge for cutting the first yarn to disengage an upper portion of the first yarn from the needle bed of the knitting machine, wherein the feeder arm includes a first outlet located at a distal end of the feeder arm, and a second outlet located at the distal end of the feeder arm, the first outlet being configured to direct a pressurized gas to guide a distal end of the first yarn to a needle of the needle bed during a starting procedure;

a second cutting device coupled to the feeder arm, wherein the second cutting device includes a second cutting edge for cutting a second yarn to disengage an upper portion of the second yarn from the needle bed of the knitting machine, and wherein the second outlet is configured to direct a pressurized gas to guide a distal end of the second yarn to a needle of the needle bed during the starting procedure; and a first yarn opening configured for directing the distal end of only the first yarn, and a second yarn opening configured for directing the distal end of only the second yarn, the first yarn opening being located below the first cutting device and the second yarn opening being located below the second cutting device.

2. The feeder of claim 1, further comprising a gripping device coupled to the feeder arm for gripping the distal end of the first yarn when the first yarn is cut by the first cutting device.

3. The feeder of claim 2, wherein the gripping device is configured to be disengaged with the first yarn when the first yarn is being dispensed to the needle bed by the dispensing area of the feeder arm.

4. The feeder of claim 1, further comprising a starting device configured to engage the distal end the first yarn with the needle bed.

5. The feeder of claim 1, further comprising a second gripping device adjacent to the second cutting device for engaging the second yarn when the second yarn is cut.

6. A feeder for a knitting machine, the feeder comprising:

a carrier configured to secure the feeder to a knitting machine such that the feeder is movable along an axis with respect to a rail of the knitting machine; and a feeder arm extending from the carrier, the feeder arm including a first dispensing area configured for supplying a first yarn to a needle bed of the knitting machine, a first outlet located at a distal end of the feeder arm, and a second outlet located at the distal end of the feeder arm, the first outlet being configured to direct a pressurized gas to guide a distal end of the first yarn and the second outlet being configured to direct a pressurized gas to guide a distal end of the second yarn to a needle of the needle bed during a starting procedure; and a first cutting device configured to cut the first yarn without cutting the second yarn, and a second cutting device configured to cut the second yarn without cutting the first yarn, and a first yarn opening configured for directing the distal end of only the first yarn, and a second yarn opening configured for directing the distal end of only the second yarn, the first yarn opening being located below the first cutting device and the second yarn opening being located below the second cutting device, and wherein during the starting procedure, the pressurized gas moves through the first outlet and the second outlet.

7. The feeder of claim 6, wherein the feeder comprises the first cutting device coupled to the feeder arm, wherein the first cutting device is configured to cut the first yarn to disengage the first yarn from the needle bed of the knitting machine.

8. The feeder of claim 7, further comprising a first gripping device coupled to the feeder arm for gripping the distal end of the first yarn when the first yarn is cut by the first cutting device.

9. The feeder of claim 8, further comprising a second gripping device coupled to the feeder arm for gripping the distal end of the second yarn when the second yarn is cut by the second cutting device.

10. The feeder of claim 8, wherein the first gripping device is configured to be disengaged with the first yarn when the first yarn is being dispensed.

11. The feeder of claim 6, further comprising a starting device configured to engage the distal end of at least one of the first yarn and the second yarn with the needle bed, and wherein the starting device causes flow of the pressurized gas.

12. The feeder of claim 6, wherein the feeder comprises a first cutting device that is actuated through movement of an actuation arm coupled to the carrier.

13. A method, the method comprising:

knitting with a first yarn with a feeder such that the first yarn moves through a first yarn opening;

cutting the first yarn with a first cutting device, the first cutting device being coupled to an arm of the feeder, wherein the first cutting device is located below the first yarn opening;

gripping the first yarn with a first gripping device, the first gripping device being coupled to the arm of the feeder; and knitting with a second yarn with the feeder such that the second yarn moves through a second yarn opening, wherein the arm of the feeder includes a first outlet that is located at a distal end of the arm of the feeder, and a second outlet that is located at the distal end of the arm of the feeder, wherein the first outlet is configured for directing a pressurized gas to guide a distal end of only the first yarn, and wherein the second outlet is configured for directing a pressurized gas to guide a distal end of only the second yarn.

14. The method of claim 13, further comprising:

cutting the second yarn with a second cutting device coupled to the arm of the feeder;

gripping the second yarn with a second gripping device coupled to the arm of the feeder; and again knitting with the first yarn with the feeder.

15. The method of claim 13, further comprising the step of engaging the second yarn with a needle bed using a starting device prior to knitting with the second yarn.

16. The method of claim 15, wherein engaging the second yarn with the needle bed includes releasing the pressurized gas to guide the second yarn to the needle bed.

* * * * *